US010966513B2

(12) United States Patent
Kong

(10) Patent No.: US 10,966,513 B2
(45) Date of Patent: Apr. 6, 2021

(54) SYNTHETIC GOAT HAIR BRUSH

(71) Applicant: HCT GROUP HOLDINGS LIMITED, Sheung Wan (CN)

(72) Inventor: Cathy Kong, Los Angeles, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 43 days.

(21) Appl. No.: 16/298,955

(22) Filed: Mar. 11, 2019

(65) Prior Publication Data

US 2019/0281970 A1 Sep. 19, 2019

Related U.S. Application Data

(60) Provisional application No. 62/643,418, filed on Mar. 15, 2018.

(51) Int. Cl.

| | |
|---|---|
| ***A46B 9/02*** | (2006.01) |
| ***A46B 1/00*** | (2006.01) |
| ***A46D 1/00*** | (2006.01) |
| *A46D 99/00* | (2006.01) |
| *A46B 3/10* | (2006.01) |

(52) U.S. Cl.

CPC ..... *A46B 9/021* (2013.01); *A46D 1/02* (2013.01); *A46D 1/0207* (2013.01); *A46B 3/10* (2013.01); *A46B 9/028* (2013.01); *A46B 2200/1046* (2013.01); *A46D 99/00* (2013.01)

(58) Field of Classification Search

CPC ..... A46D 1/02; A46D 1/0207; A46D 1/0253; A46D 1/0261; A46B 9/021; A46B 9/06; A46B 2200/1046

See application file for complete search history.

(56) References Cited

U.S. PATENT DOCUMENTS

| | | | |
|---|---|---|---|
| 715,881 | A | 12/1902 | Scott |
| 783,937 | A | 2/1905 | Edwards et al. |
| 987,277 | A | 3/1911 | Wright |
| 1,030,440 | A | 6/1912 | Jvaterman |
| 1,065,879 | A | 6/1913 | Krebs |
| 1,067,596 | A | 7/1913 | Fester |
| 1,112,193 | A | 9/1914 | Carleton et al. |
| 1,142,698 | A | 6/1915 | Grove et al. |

(Continued)

FOREIGN PATENT DOCUMENTS

| | | | |
|---|---|---|---|
| CN | 1196212 | A | 10/1998 |
| CN | 201734124 | U | 2/2011 |

(Continued)

OTHER PUBLICATIONS

Computer generated English translation of KR 101643405 B1, Kim et al., Jul. 2016. (Year: 2016).*

(Continued)

*Primary Examiner* — Laura C Guidotti

(74) *Attorney, Agent, or Firm* — Seager, Tufte & Wickhem LLP.

(57) ABSTRACT

A blended cosmetic brush head may include a first plurality of fibers each having a first diameter, a second plurality of fibers each having a second diameter, and a third plurality of fibers each having a third diameter, where the first, second, and third diameters are different. The brush may be adapted to simulate a natural hair brush, more particularly, goat hair.

8 Claims, 3 Drawing Sheets

(56) References Cited

U.S. PATENT DOCUMENTS 1,170,923 A 2/1916 Malkin
1,185,617 A 6/1916 Blaha et al.
1,188,214 A 6/1916 Sohn
1,190,227 A 7/1916 Fesler
D51,319 S 10/1917 Montgomery
1,261,502 A 4/1918 Farrows
1,274,697 A 8/1918 Dynowsky
1,355,026 A 10/1920 Austin
1,358,597 A 11/1920 Tobias
1,429,823 A 9/1922 Allison
1,457,615 A 6/1923 Bunker
1,506,292 A 8/1924 Corsello
1,510,898 A 10/1924 Nikicser
1,563,031 A 11/1925 Jones
1,626,992 A 5/1927 Willk
1,639,388 A 8/1927 Stebbings
1,651,355 A 12/1927 Alland
1,659,800 A 2/1928 Bailey
1,831,393 A 11/1931 Pierce, Jr.
1,889,496 A 11/1932 Priest
2,104,651 A 1/1938 Hoffman, Jr.
2,132,943 A 10/1938 Frazier
D134,797 S 1/1943 Lubkin
2,321,265 A 6/1943 Ulvick
2,442,051 A 5/1948 Luscri
2,485,822 A 10/1949 Goldrich
2,591,537 A 4/1952 Gordon
2,637,060 A 5/1953 Cowan
2,637,868 A 5/1953 Hamilton
2,697,642 A 12/1954 Rudy
2,701,378 A 2/1955 Reinbolt et al.
2,736,051 A 2/1956 Boodakian
2,825,080 A 3/1958 Bongiovanni
2,866,993 A 1/1959 Edelstone
2,874,399 A 2/1959 Solomon
2,946,072 A 7/1960 Filler et al.
2,982,983 A 5/1961 Peterson
3,007,188 A 11/1961 Dolan
3,106,738 A 10/1963 Bohne
3,193,863 A 7/1965 Myers et al.
3,205,523 A 9/1965 Seaver
D204,449 S 4/1966 Zavodsky
3,309,728 A 3/1967 Seaver
3,592,202 A 7/1971 Jones
3,863,288 A 2/1975 Aversa
3,908,676 A 9/1975 Levine et al.
D245,462 S 8/1977 Hauf
4,088,413 A 5/1978 Rossignol de la Ronde et al.
D249,600 S 9/1978 Bowman
4,129,918 A 12/1978 Lee et al.
4,165,755 A 8/1979 Cassai
4,204,294 A 5/1980 Halverson
D258,241 S 2/1981 Takada et al.
4,248,543 A 2/1981 Carrington et al.
4,428,388 A 1/1984 Cassai et al.
4,446,880 A 5/1984 Gueret et al.
4,483,036 A 11/1984 Sayklay
4,502,497 A 3/1985 Siahou et al.
D278,951 S 5/1985 Kalinsky
4,600,328 A 7/1986 Clements
4,727,618 A 3/1988 Mahoney et al.
D297,889 S 10/1988 Ries et al.
4,898,193 A 2/1990 Gueret et al.
4,906,120 A 3/1990 Sekiguchi et al.
4,917,132 A 4/1990 Tuchman
4,927,281 A 5/1990 Gueret et al.
D310,917 S 10/1990 Futter
5,063,947 A 11/1991 Gueret et al.
5,137,038 A 8/1992 Kingsford et al.
5,153,066 A 10/1992 Tanaka et al.
5,165,760 A 11/1992 Gueret et al.
5,211,494 A 5/1993 Baijnath et al.
5,220,702 A 6/1993 Howell et al.
5,301,695 A 4/1994 Wong
5,328,282 A 7/1994 Charrier et al.
5,339,483 A 8/1994 Byun et al.
5,388,599 A 2/1995 Yen et al.
D362,965 S 10/1995 Tastanis
5,482,059 A 1/1996 Miraglia
5,491,865 A 2/1996 Gueret
5,507,063 A 4/1996 Hirsch
5,535,474 A 7/1996 Salazar
5,588,447 A 12/1996 Gueret
5,596,785 A 1/1997 Park
D380,615 S 7/1997 Roberts
5,690,441 A 11/1997 McManus
5,778,479 A 7/1998 Raia
5,802,658 A 9/1998 Ward
5,960,745 A 10/1999 Boyland
5,992,423 A 11/1999 Tevolini
6,026,824 A 2/2000 Gueret
D421,846 S 3/2000 Choe
6,039,051 A 3/2000 Dort
D425,794 S 5/2000 Grossnickle
6,059,474 A 5/2000 Huang
6,070,597 A 6/2000 Motherhead
D434,187 S 11/2000 Schoon et al.
6,145,151 A 11/2000 Herron et al.
6,145,514 A 11/2000 Clay et al.
6,158,443 A 12/2000 Leman et al.
6,164,857 A 12/2000 Wolfarth-Brooks et al.
D439,415 S 3/2001 Mink et al.
D442,369 S 5/2001 Damiano
6,224,287 B1 5/2001 Gieux
6,226,828 B1 5/2001 Lin
6,234,181 B1 5/2001 Lou
6,269,515 B1 8/2001 Varma
D448,178 S 9/2001 Tapley et al.
6,298,863 B1 10/2001 Byun
6,309,125 B1 10/2001 Peters
D450,189 S 11/2001 Mink et al.
D450,930 S 11/2001 Mink et al.
D450,931 S 11/2001 Mink et al.
6,311,358 B1 11/2001 Soetewey et al.
6,312,182 B1 11/2001 Dumler
D451,681 S 12/2001 Mink et al.
D454,001 S 3/2002 Mink et al.
6,363,948 B2 4/2002 Choi
6,401,290 B1 6/2002 Barton et al.
6,405,402 B1 6/2002 Choi
6,418,939 B1 7/2002 Byun
6,438,784 B1 8/2002 Yu
D471,018 S 3/2003 Mink
D479,917 S 9/2003 Mink
D479,918 S 9/2003 Mink
D480,218 S 10/2003 Mink
6,669,389 B2 12/2003 Gueret
D485,442 S 1/2004 Twigg
6,832,405 B1 12/2004 Miller
6,880,197 B2 4/2005 Katz et al.
6,898,818 B2 5/2005 Lin
D506,069 S 6/2005 Woods
6,935,802 B1 8/2005 Byun
6,957,468 B2 10/2005 Driesen et al.
6,974,513 B2 12/2005 Kepka
7,096,598 B1 8/2006 Myatt
D527,529 S 9/2006 Ajluni et al.
D528,305 S 9/2006 Langer
7,101,107 B1 9/2006 Byun
7,107,645 B2 9/2006 Bressler et al.
7,111,354 B2 9/2006 Nennig et al.
D529,292 S 10/2006 Langer
7,127,770 B2 10/2006 Clegg et al.
7,159,950 B2 1/2007 Young-Chul
7,201,527 B2 4/2007 Thorpe et al.
7,234,474 B2 6/2007 Byun
7,275,885 B2 10/2007 Byun
D562,005 S 2/2008 King
D562,566 S 2/2008 Mink
7,344,327 B2 3/2008 Gueret
D566,969 S 4/2008 Sherman et al.
D568,050 S 5/2008 Huang
D571,105 S 6/2008 Godin
7,429,141 B2 9/2008 Habatjou

(56) References Cited

U.S. PATENT DOCUMENTS

| | | | |
|---|---|---|---|
| 7,465,113 | B2 | 12/2008 | Gueret |
| D584,897 | S | 1/2009 | Belley |
| D601,804 | S | 10/2009 | Hwang |
| 7,653,960 | B2 | 2/2010 | Lee |
| D612,615 | S | 3/2010 | Chitayat et al. |
| 7,716,775 | B2 | 5/2010 | DiPietro et al. |
| D626,338 | S | 11/2010 | Ajootian |
| 7,866,758 | B2 | 1/2011 | Jang |
| D631,666 | S | 2/2011 | Lim |
| D632,488 | S | 2/2011 | Twigg |
| 7,895,696 | B2 | 3/2011 | Belmonte |
| 7,895,698 | B2 | 3/2011 | Mink |
| 7,918,620 | B2 | 4/2011 | Del Ponte |
| 7,950,402 | B1 | 5/2011 | Cole |
| 7,996,947 | B2 | 8/2011 | Gueret |
| 8,074,666 | B2 | 12/2011 | Piao |
| D651,409 | S | 1/2012 | Papenfu |
| 8,104,132 | B2 | 1/2012 | Mink |
| 8,117,707 | B1 | 2/2012 | Ruh, II |
| 8,132,285 | B2 | 3/2012 | Piao |
| 8,132,541 | B1 | 3/2012 | Baer, Jr. |
| D658,385 | S | 5/2012 | Lim et al. |
| D658,389 | S | 5/2012 | Salgatar |
| 8,185,998 | B2 | 5/2012 | Xu |
| 8,220,469 | B1 | 7/2012 | Spagnuolo |
| 8,230,543 | B2 | 7/2012 | Shrier et al. |
| 8,251,074 | B2 | 8/2012 | Pires et al. |
| 8,256,058 | B2 | 9/2012 | Telwar |
| 8,307,836 | B2 | 11/2012 | Pires et al. |
| 8,321,987 | B2 | 12/2012 | Bagley |
| 8,360,078 | B2 | 1/2013 | Lim et al. |
| D677,059 | S | 3/2013 | Floyd |
| D677,060 | S | 3/2013 | Floyd |
| D677,470 | S | 3/2013 | Floyd |
| 8,402,592 | B2 | 3/2013 | Byrne et al. |
| D681,342 | S | 5/2013 | Brower |
| 8,850,652 | B2 | 10/2014 | Lim |
| D717,548 | S | 11/2014 | Lim |
| 8,881,745 | B2 | 11/2014 | Pires et al. |
| 8,899,243 | B2 | 12/2014 | Pires et al. |
| D725,912 | S | 4/2015 | Sims et al. |
| D730,062 | S | 5/2015 | Lim |
| 9,089,200 | B2 | 7/2015 | Telwar et al. |
| D739,148 | S | 9/2015 | Lim |
| D767,903 | S | 10/2016 | Lim |
| D778,069 | S | 2/2017 | Lim |
| 2002/0078902 | A1 | 6/2002 | Ehrmann |
| 2002/0148058 | A1 | 10/2002 | Greenwood et al. |
| 2003/0005533 | A1 | 1/2003 | Woodnorth et al. |
| 2003/0035953 | A1 | 2/2003 | Weihrauch |
| 2003/0066151 | A1 | 4/2003 | Chang |
| 2003/0110585 | A1 | 6/2003 | Rechelbacher |
| 2004/0134009 | A1 | 7/2004 | Sander et al. |
| 2004/0168700 | A1 | 9/2004 | Dorf |
| 2005/0011030 | A1 | 1/2005 | Gonzalez |
| 2005/0031401 | A1 | 2/2005 | Gueret |
| 2005/0198759 | A1 | 9/2005 | Segrea |
| 2005/0273962 | A1 | 12/2005 | Dillon |
| 2006/0026783 | A1 | 2/2006 | McKay |
| 2006/0150355 | A1 | 7/2006 | Mason et al. |
| 2006/0162736 | A1 | 7/2006 | Gray |
| 2006/0254012 | A1 | 11/2006 | Konishi |
| 2006/0272668 | A1 | 12/2006 | Wyatt et al. |
| 2007/0034224 | A1 | 2/2007 | Dumler |
| 2007/0124882 | A1 | 6/2007 | Lee |
| 2007/0151061 | A1 | 7/2007 | Mink et al. |
| 2007/0199575 | A1 | 8/2007 | Del Ponte |
| 2007/0289602 | A1 | 12/2007 | Simmons |
| 2007/0295351 | A1 | 12/2007 | Germer |
| 2008/0060668 | A1 | 3/2008 | Legassie |
| 2008/0256733 | A1 | 10/2008 | Brown |
| 2008/0276396 | A1 | 11/2008 | Lucero |
| 2009/0041530 | A1 | 2/2009 | Deans |
| 2009/0089949 | A1 | 4/2009 | Mink et al. |
| 2009/0119863 | A1 | 5/2009 | Gallegos |
| 2009/0183328 | A1 | 7/2009 | King |
| 2009/0260172 | A1 | 10/2009 | Weiss |
| 2010/0017990 | A1 | 1/2010 | Piao |
| 2010/0037407 | A1 | 2/2010 | Telwar |
| 2010/0043815 | A1 | 2/2010 | Levy et al. |
| 2010/0059080 | A1 | 3/2010 | Gueret |
| 2010/0236004 | A1 | 9/2010 | Xu |
| 2011/0056505 | A1 | 3/2011 | Parkinson et al. |
| 2011/0083690 | A1 | 4/2011 | Cardenas et al. |
| 2012/0017930 | A1 | 1/2012 | Nance |
| 2012/0260931 | A1 | 10/2012 | Martin et al. |
| 2012/0272982 | A1 | 11/2012 | Telwar et al. |
| 2012/0298130 | A1 | 11/2012 | Telwar |
| 2013/0017010 | A1 | 1/2013 | Liu |
| 2013/0111683 | A1 | 5/2013 | Lim et al. |
| 2014/0259489 | A1 | 9/2014 | Dale |
| 2014/0325775 | A1 | 11/2014 | Nakamura et al. |
| 2014/0331422 | A1 | 11/2014 | Lim |
| 2014/0332027 | A1 | 11/2014 | Lim |
| 2016/0135582 | A1 | 5/2016 | Yen |
| 2017/0251798 | A1 | 9/2017 | Barozzi |
| 2017/0265626 | A1 | 9/2017 | Earl et al. |
| 2018/0242711 | A1* | 8/2018 | Poole ..... A46B 13/023 |

FOREIGN PATENT DOCUMENTS

| | | | |
|---|---|---|---|
| CN | 201734141 | U | 2/2011 |
| CN | 201929278 | U | 8/2011 |
| CN | 302655796 | S | 11/2013 |
| CN | 302667633 | S | 12/2013 |
| CN | 303098564 | S | 2/2015 |
| DE | 29713124 | U1 | 9/1997 |
| EP | 2084986 | A2 | 8/2009 |
| FR | 2464674 | A1 | 3/1981 |
| FR | 2642283 | A1 | 8/1990 |
| FR | 2976463 | A1 | 12/2012 |
| JP | 2003033228 | A | 2/2003 |
| JP | 2003135140 | A | 5/2003 |
| JP | 1218834 | C | 10/2004 |
| JP | 1343552 | C | 11/2008 |
| JP | 2009172300 | A | 8/2009 |
| KR | 300365471 | | 10/2004 |
| KR | 300404554 | | 12/2004 |
| KR | 300607863 | | 8/2011 |
| KR | 101643405 | B1 | 7/2016 |
| WO | 9211785 | A1 | 7/1992 |
| WO | 2006034815 | A2 | 4/2006 |
| WO | 2007117091 | A1 | 10/2007 |

OTHER PUBLICATIONS

International Search Report and Written Opinion dated Jun. 11, 2019 for International Application No. PCT/US2019/021680.

All for One, Full Magnetic Travel Brush Set, Sephora, retrieved on Feb. 26, 2015 at <>, 3 pages.

CN 3412782 Registered Design, (Tianjin Samsung Brushes Ltd.) Dec. 22, 2004 [online], [retrieved on Oct. 3, 2014] Retrieved from the Questel Intellectual Property Portal Design Database Using the Internet: http://www.orbit.com.

CN 3412783 Registered Design, (Tianjin Samsung Brushes Ltd.) Dec. 22, 2004 [online], [retrieved on Oct. 3, 2014] Retrieved from the Questel Intellectual Property Portal Design Database Using the Internet: http://www.orbit.com.

On 3412785 Registered Design, (Tianjin Samsun Brushes Ltd.) Dec. 22, 2004, [online], [retrieved on Oct. 3, 2014] Retrieved from the Questel Intellectual Property Portal Design Database using the Internet: http://www.orbit.com.

CN 3417893 Registered Design, (Tianjin Samsun Brushes Ltd.) Jan. 12, 2005, [online], [retrieved on Oct. 3, 2014] Retrieved from the Questel Intellectual Property Portal Design Database using the Internet: <URL: http://www.orbit.com.

CN 3466155 Registered Design, (Tianjin Samsung Brushes Ltd.) Aug. 10, 2005 [online], [retrieved on Aug. 26, 2014] Retrieved from the Questel Intellectual Property Portal Design Database Using the Internet: http://www.orbit.com.

(56) References Cited

OTHER PUBLICATIONS

Da Vinci Catalog, Novelties 2005-2008, .COPYRGT. Jan. 2008 [online], Top-point Mix B series 5535 Brushes, [retrieved on Mar. 13, 2015].
Dual Interchangeable Brush Set, Global Market, retrieved on Mar. 18, 2015 at <>, 2 pages.
Everbluec Singapore Beauty Makeup and Skincare Blog, May 14, 2011 [online], Elizabeth Arden makeup blender, [retrieved on Mar. 14, 2015] Retrieved from the Internet: http://everbluec.com/2011/05/ceramide-colors-exclusive-launch-at.html>-.
Fingermax Creative Finger Painting Paint Brush, retrieved on Oct. 9, 2014 at ,,http://thesotre.com/fingermax-creative-finger-painting-paint-br- ush/TSHVY6X6YF>>, 5 pages.
Givenchy Demesure Audacious Lashes Mascara, May 17, 2011, retrieved from the internet at <>, 9 pages.
Indeutsch May 2003 [online], Hobby & Craft Brushes, Series HCS: Squirrel Mop, p. 2, [retrieved on Jun. 30, 2014] Retrieved from the Internet using Web Archive: URL: https://www.indeutsch.com/hobby-and-craft-brushes/hobby-brushes1.html.
Lady Zona, "Choosing the Right Make Up Brush", Retrieved on Feb. 24, 2015 at <&- gt;, 3 pages.
Latest design double end kabuki blush brush, Alibaba.com, retrieved on Mar. 18, 2015 at <>, 3 pages.
Launch Pad Mojo Magpro Professional Magnetic Brush Set, Beauty and the Blog, retrieved on Feb. 26, 2015 at «http://www.beautyandblog.com/2012/01/launch-pad-mojo-magpro-profe- ssional.html, 4 pages.
LeKeux, "My Cosmetic Range" LeKeux HQ, retrieved on Feb. 24, 2015 at <&- gt;, 6 Pages.
Makeup Brushes Buying Guide, Ebay, Jun. 9, 2014, retrieved on Mar. 18, 2015 at <>, 6 pages.
Popcorn Yubi-fude Finger Brush, Japan Trend Shop, retrieved on Oct. 8, 2014 at <>, 3 pages.
Why Didn't We Think of That: Magnetic Makeup Brush, Gloss Daily, retrieved on Feb. 26, 2015 at <>, 2 pages.

* cited by examiner

SYNTHETIC GOAT HAIR BRUSH

CROSS REFERENCE TO RELATED APPLICATIONS

The present application claims the benefit of and priority to U.S. Provisional Patent Application Ser. No. 62/643,418, filed on Mar. 15, 2018, titled SYNTHETIC GOAT HAIR BRUSH, the disclosure of which is incorporated herein by reference.

BACKGROUND

Numerous types of brushes with natural and synthetic animal hair are available for applying cosmetic products. New and alternative approaches to such brushes are desired.

SUMMARY

This disclosure provides designs, material, manufacturing methods, and use alternatives for cosmetic packaging.

According to one example of the present disclosure, a blended cosmetic brush head comprises a first plurality of fibers each having a first diameter, a second plurality of fibers each having a second diameter, and a third plurality of fibers each having a third diameter, where the first, second, and third diameters are different.

Alternatively, or additionally, in another example, second diameter is larger than the first diameter and the third diameter is larger than the second diameter.

Alternatively, or additionally, in another example, the second diameter is 0.01 mm larger than the first diameter and the third diameter is 0.01 mm larger than the second diameter.

Alternatively, or additionally, in another example, the first diameter is 0.05 mm, the second diameter is 0.06 mm, and the third diameter is 0.07 mm.

Alternatively, or additionally, in another example, the first and second plurality of fibers are present in a first amount, and the third plurality of fibers is present in a second amount that is three times the first amount.

Alternatively, or additionally, in another example, at least one of the first, second, and third plurality of fibers includes synthetic fibers.

Alternatively, or additionally, in another example, all of the plurality of fibers includes synthetic fibers.

Alternatively, or additionally, in another example, at least some of the first, second, or third plurality of fibers include fibers made of Polybutylene Terephthalate (PBT).

Alternatively, or additionally, in another example, all of the plurality of fibers include fibers made of Polybutylene Terephthalate (PBT).

Alternatively, or additionally, in another example, at least some of the first, second, or third plurality of fibers include fibers that are crimped.

Alternatively, or additionally, in another example, all of the plurality of fibers include fibers that are crimped.

Alternatively, or additionally, in another example, all of the fibers from the first, second, and third plurality of fibers are mixed together.

According to another example, a blended cosmetic brush head comprises a first plurality of fibers each having a diameter of 0.05 mm, a second plurality of fibers each having a diameter of 0.06 mm, and a third plurality of fibers each having a diameter of 0.07 mm, wherein the first, second, and third plurality of fibers are blended in a ratio of 20% first plurality of fibers, 20% second plurality of fibers, and 60% third plurality of fibers.

Alternatively, or additionally, in another example, at least one of the first, second, and third plurality of fibers includes synthetic fibers.

Alternatively, or additionally, in another example, all of the plurality of fibers includes synthetic fibers.

Alternatively, or additionally, in another example, at least some of the first, second, or third plurality of fibers include fibers made of Polybutylene Terephthalate (PBT).

Alternatively, or additionally, in another example, all of the plurality of fibers include fibers made of Polybutylene Terephthalate (PBT).

Alternatively, or additionally, in another example, at least some of the first, second, or third plurality of fibers include fibers that are crimped.

Alternatively, or additionally, in another example, all of the plurality of fibers include fibers that are crimped.

Alternatively, or additionally, in another example, all of the fibers from the first, second, and third plurality of fibers are mixed together.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the present invention are best understood from the following detailed description when read in connection with the accompanying drawings. The drawings illustrate generally, by way of example, but not by way of limitation, various embodiments discussed in the present document.

Included in the drawings are the following Figures.

DETAILED DESCRIPTION

Figure 1:
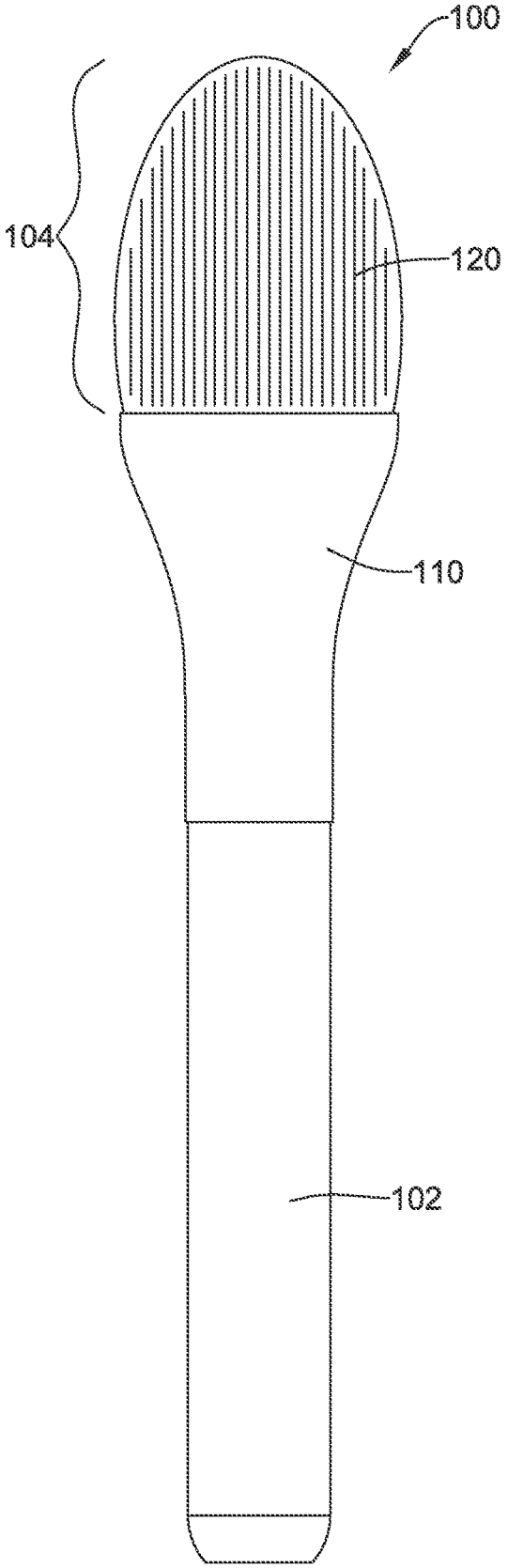
FIG. 1 is a front view of an illustrative brush.

The following description should be read with reference to the drawings wherein like reference numerals indicate like elements throughout the several views. The description and drawings show several embodiments which are meant to be illustrative in nature.

For convenience, the present disclosure may be described using relative terms including, for example, left, right, top, bottom, front, back, upper, lower, up, and down, as well as others. It is to be understood that these terms are merely used for illustrative purposes and are not meant to be limiting in any manner.

In the following description, a brush is described for applying a cosmetic material. While the application describes the fibers for use in a cosmetic brush, it will be understood that the synthetic fibers according to this application are usable in other applications such as, for example, mascara brush, tooth brushes, hair brushes, etc.

Cosmetic brushes may be formed using many types of natural and/or synthetic fibers. Brushes may include natural (e.g., sable hair, squirrel hair, goat hair, etc.) and/or synthetic (e.g., nylon, taklon, polyester, silicone, etc.) fibers.

Natural fibers have long been used due to their softness. Goat hair brushes, for example, are very soft, resilient and durable, and goat hair excels at creating depth of color by picking up the desired amount of product. Goat hair fibers may be used in brushes for powder, blush, highlighter and eye shadow.

Goat hair is one of the most commonly used natural hair type in making cosmetic brushes as they are the least costly of the natural hair brushes to make due to the wide availability of goat hair. Natural hair fibers have cuticles, which provide good product pick-up and blending properties. The cuticle helps lift and absorb powdered pigment along with the skin's oils and blend them across the skin, creating a natural, blended look. Natural hair fibers are porous, however, and absorb liquid and cream products, which may lead to clumping and waste of the product.

Synthetic fiber brushes have an advantage in that each fiber may be made to precise size and shape specifications, and may provide a more precise, streak-free application of the cosmetic product, especially for liquid, gel, and cream products. Synthetic fibers may be cut to provide a more precise angle for small detail brushes, as compared to natural hair brushes. Synthetic fibers may be made with a smooth surface devoid of pores or with pores of a desired size to control the amount of liquid, gel, or cream product the brush absorbs.

Examples of synthetic materials that may be used to form the brush fibers include, without limitation, taklon, nylon, Polybutylene Terephthalate (PBT), Polyethylene Terephthalate (PET), polyester and/or Polypropylene (PP).

In view of the various challenges and drawbacks of using natural goat hair in cosmetics brushes, the inventors have developed a synthetic goat hair brush. FIG. 1 is a schematic diagram of an example brush 100 having a handle 102, a brush head 104, and a ferrule 110. In some examples, the handle 102 may be made of a metal material (e.g., steel, stainless steel, nickel, aluminum, magnesium, copper, brass, chrome, titanium, alloys thereof, etc.), plastic material (e.g., acrylic, polypropylene, polyvinyl chloride, acrylonitrile butadiene styrene, etc.), wood material, glass, stone, ceramic material, graphite material, composite material (e.g., fiberglass, carbon fiber, etc.), combinations of the foregoing, etc. The handle 102 may have a variety of cross-sectional shapes, sizes, cross-sectional areas, and/or lengths. In some examples, the handle 102 may have a cross section perpendicular to a longitudinal axis having a circular shape, a triangular shape, a rectangular shape, an ovular shape, a hexagonal shape, an abstract shape, etc.

The brush head 104 may include a plurality of fibers 120. As shown, the brush head 104 has a wide face with a rounded or curved, edge. However, it will be understood that the specific function of the brush may dictate its exact shape. The brush may be of virtually any shape such as flat and rectangular, trapezoidal or angled with relatively straight edges. The size and shape of the brush may depend on the product to be applied, the location to which the product is to be applied and/or the method in which the product is to be applied. For example, a brush for applying blush may have fibers arranged in a circular shape with a dome head contour. In contrast, a brush for applying foundation may have brush fibers arranged to create a flat brush head with an at least partially semi-circular head contour. A brush for applying powder or creams to the eyebrows may have brush fibers arranged to create a flat, stiff brush head.

The brush head 104 may include a mixture or blend of different fibers 120. The blend of fibers may include fibers made of different materials such as a blend of natural and synthetic fibers. The ratio of natural to synthetic fibers may be altered based on the desired characteristics of the brush. In other examples, all of the fibers in the brush head may be synthetic. The fibers 120 in the brush head 104 may all be made of the same type of synthetic material. Alternatively, the individual fibers 120 may be made of different materials. At least some of the fibers may be made of Polybutylene Terephthalate (PBT). In other examples, all of the fibers in the brush head may be made of PBT.

Figure 2:
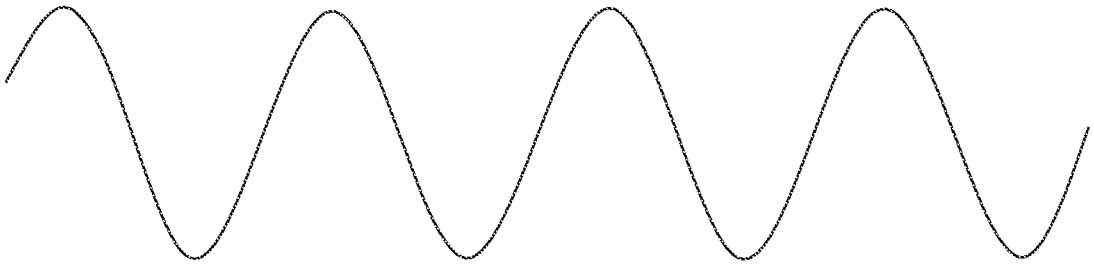
FIG. 2 shows a wavy outer surface shape for a synthetic fiber.

The fibers 120 in the brush head 104 may be cylindrical in shape, with a straight, smooth outer surface. In other examples, the fibers may have a wavy outer surface shape, such as that shown in FIG. 2. The artificial fibers may be crimped to provide the wavy shape. In some examples, all of the fibers in the brush head have the same shape. In other examples, a mixture of straight and crimped fibers may be provided. When fibers of different material, size, and/or shape are used in a single brush head, the fibers may be arranged with similar fibers clustered together. Alternatively, the fibers may be blended into a substantially random arrangement of the different materials, size, and/or shape.

Figure 3:
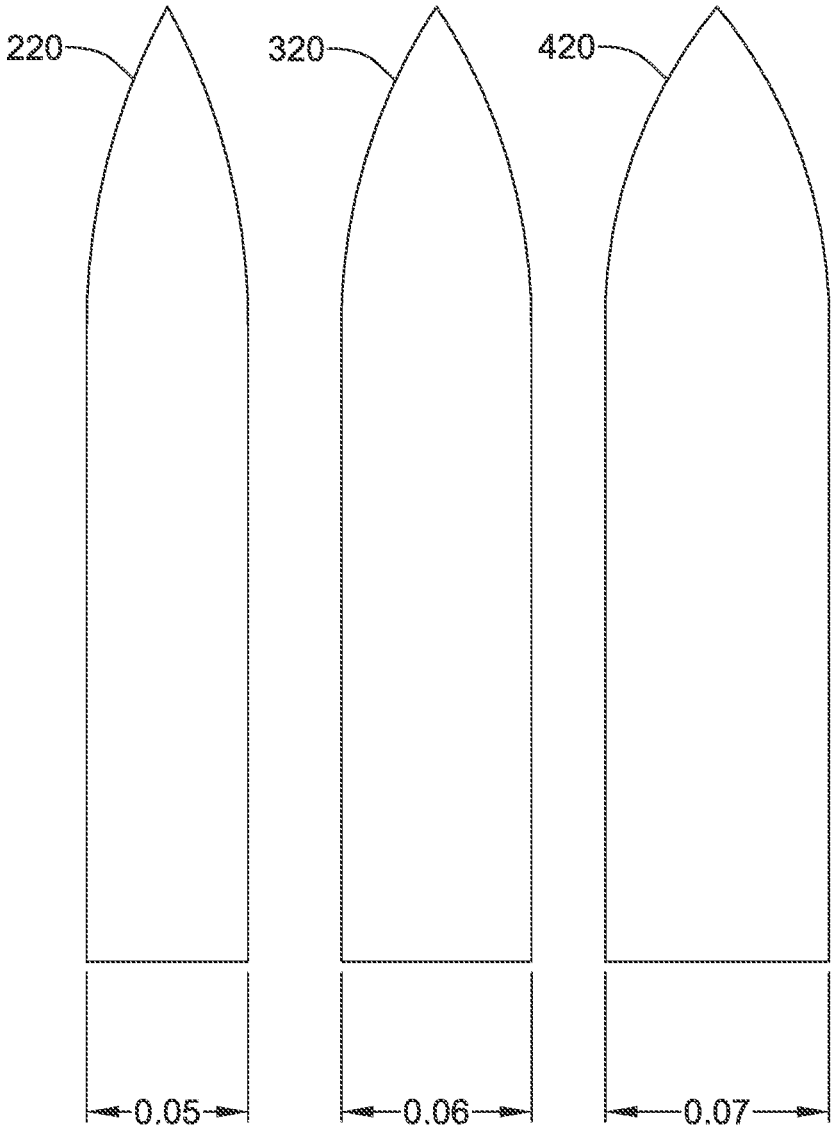
FIG. 3 shows three exemplary synthetic fibers having differing diameters.

The fibers 120 in the brush head 104 may be made of a mixture of natural and synthetic materials. In other examples, the fibers may be made of different synthetic materials or the fibers may all be made of the same synthetic material. In one example, all of the fibers may be made of Polybutylene Terephthalate (PBT) but the fibers may have different diameters. The fibers may have differing diameters. For example, as shown in FIG. 3, a first plurality of fibers 220 may each have a first diameter, a second plurality of fibers 320 may each have a second diameter, and a third plurality of fibers 420 may each have a third diameter, with the first, second, and third diameters being different. The second diameter may be larger than the first diameter and the third diameter may be larger than the second diameter. In some examples, the first, second, and third diameters differ by 0.01 mm, with the second diameter being 0.01 mm larger than the first diameter and the third diameter being 0.01 mm larger than the second diameter. In one example, the first plurality of fibers 220 may include fibers each having a diameter of 0.05 mm, the second plurality of fibers 320 may include fibers each having a diameter of 0.06 mm, and the third plurality of fibers 420 may include fibers each having a diameter of 0.07 mm.

The first, second, and third plurality of fibers may be blended in various ratios. The three groups of fibers may be blended in equal ratios. In another example, the first and second plurality of fibers may be present in the same amount, and the third plurality of fibers may be present in an amount three times the amounts of the first and second plurality of fibers. In another example, the first, second, and third plurality of fibers may be blended in a ratio of 20% of the first plurality of fibers, 20% of the second plurality of fibers, and 60% of the third plurality of fibers.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A blended cosmetic brush head comprising:

a first plurality of fibers each having a diameter of 0.05 mm;

a second plurality of fibers each having a diameter of 0.06 mm; and a third plurality of fibers each having a diameter of 0.07 mm;

wherein the first, second, and third plurality of fibers are blended in a ratio of 20% first plurality of fibers, 20% second plurality of fibers, and 60% third plurality of fibers.

2. The blended cosmetic brush head of claim 1, wherein at least one of the first, second, and third plurality of fibers includes synthetic fibers.

3. The blended cosmetic brush head of claim 2, wherein all of the plurality of fibers includes synthetic fibers.

4. The blended cosmetic brush head of claim 1, wherein at least some of the first, second, or third plurality of fibers include fibers made of Polybutylene Terephthalate (PBT).

5. The blended cosmetic brush head of claim 1, wherein all of the plurality of fibers include fibers made of Polybutylene Terephthalate (PBT).

6. The blended cosmetic brush head of claim 1, wherein at least some of the first, second, or third plurality of fibers include fibers that are crimped.

7. The blended cosmetic brush head of claim 1, wherein all of the plurality of fibers include fibers that are crimped.

8. The blended cosmetic brush head of claim 1, wherein all of the fibers from the first, second, and third plurality of fibers are mixed together.

* * * * *